US008672449B2

(12) United States Patent
Arima et al.

(10) Patent No.: US 8,672,449 B2
(45) Date of Patent: Mar. 18, 2014

(54) INKJET RECORDING APPARATUS

(75) Inventors: Takahiro Arima, Hitachi (JP); Akira Miyao, Hitachi (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 13/562,475

(22) Filed: Jul. 31, 2012

(65) Prior Publication Data

US 2013/0083124 A1 Apr. 4, 2013

(30) Foreign Application Priority Data

Sep. 30, 2011 (JP) ..... 2011-216007

(51) Int. Cl.

| | |
|---|---|
| ***B41J 2/20*** | (2006.01) |
| ***B41J 2/185*** | (2006.01) |
| ***B41J 29/377*** | (2006.01) |
| ***B41J 2/17*** | (2006.01) |

(52) U.S. Cl.

CPC ..... *B41J 29/377* (2013.01); *B41J 2/1707* (2013.01)

USPC ..... 347/34; 347/89

(58) Field of Classification Search

CPC ..... B41J 2002/1853; B41J 2/20

USPC ..... 347/34

See application file for complete search history.

(56) References Cited

U.S. PATENT DOCUMENTS

| | | | | |
|---|---|---|---|---|
| 5,331,339 | A * | 7/1994 | Takahashi | 347/89 |
| 5,532,720 | A * | 7/1996 | Krueger et al. | 347/89 |
| 2010/0097417 | A1* | 4/2010 | Hill | 347/9 |
| 2012/0001983 | A1* | 1/2012 | Asano | 347/25 |
| 2013/0127958 | A1* | 5/2013 | Plummer | 347/92 |

FOREIGN PATENT DOCUMENTS

| | | | |
|---|---|---|---|
| JP | 63-183199 | A * | 7/1988 |
| JP | 2009-172932 | | 8/2009 |

* cited by examiner

*Primary Examiner* — Shelby Fidler

(74) *Attorney, Agent, or Firm* — Antonelli, Terry, Stout & Kraus, LLP.

(57) ABSTRACT

In an inkjet recording apparatus including an ink and solvent containers, they are coupled with each other through a first exhaust channel, an exhaust gas and ink mist within the ink container are supplied to the solvent container through the first exhaust channel, and the solvent container has an ink mist removal unit removing the ink mist supplied from the first exhaust channel.

4 Claims, 7 Drawing Sheets

INKJET RECORDING APPARATUS

TECHNICAL FIELD

The present invention relates to an inkjet recording apparatus that conducts printing by ejecting ink from a nozzle.

In an inkjet recoding apparatus of a so-called continuous system, ink is ejected from a nozzle, only ink particles for use in printing are charged by a charging electrode, a flying direction of the charged ink particles is deflected by a deflection electrode to conduct printing. Ink particles not used for printing are sucked and recovered into a gutter, and again used for printing. In the gutter, circumambient air is also sucked while the ink particles are sucked and recovered. The sucked air is discharged from an interior of an ink container toward an exterior thereof because the air is continuously fed into the ink container (for example, refer to Japanese Unexamined Patent Application Publication No. 2009-172932).

SUMMARY

In Japanese Unexamined Patent Application Publication No. 2009-172932, within a recovery route for sucking the ink and the air from the gutter to recover the ink and the air within the ink container, ink mist occurs, and the ink mist drifts from the recovery route into the air within the ink container. The air within the ink container is discharged from an outlet provided in an inkjet recording apparatus main body toward an exterior of the inkjet recording apparatus main body. The ink mist within the ink container is collected into an ink liquid within a route through which the ink mist is discharged to the exterior of the inkjet recording apparatus, and the ink is spilled out of the outlet, resulting in a possibility that the circumference is contaminated with the ink.

Also, in the gutter, the ink as well as the ink is sucked and pumped into the ink container with the use of a pump located in the recovery route. Thereafter, the ink is accumulated in a lower portion of the ink container, and the air drifts in an upper portion of the ink container. However, the air within the upper portion of the ink container passes through an exhaust route located in the ink container, and is exhausted toward the exterior of the ink container because a fresh air continues to be fed into the ink container from the gutter without interruption.

In this case, a required flow rate of the air is about 80 to 200 [ml/min]. When the flow rate of the air to be sucked from the gutter becomes lower, an ink flow within the gutter becomes slow, and the ink may be spilled from a leading end of the gutter. (Conversely, when the flow rate of the air to be sucked from the gutter becomes higher, a larger amount of solvent component in the ink is volatilized within the recovery route, and the running costs are increased in order to exhaust the volatilized solvent.)

That is, in Japanese Unexamined Patent Application Publication No. 2009-172932, the ink mist is collected into the ink and deposited in the exhaust route to narrow the exhaust route, to thereby decrease the flow rate of the air that can be discharged from the exhaust route. This makes it difficult to suck the fresh ink and air from the gutter (because the flow rate of the air to be sucked from the gutter is decreased). As a result, there is a risk that the ink is spilled out of the gutter, and the circumference is contaminated with the ink.

An object of the present invention is to prevent discharge of the ink mist generated within the recovery route toward the exterior of the device, and the deposition of the ink within the route.

In order to solve the above problem, for example, there is provided an inkjet recording apparatus including: an ink container for storing ink which is housed in a main body; a solvent container that accommodates solvent for supplying the solvent to the ink container in order to adjust a concentration of the ink within the ink container; a nozzle that ejects the ink supplied from the ink container through an ink supply channel as ink particles to conduct printing on an object to be printed; a gutter for recovering the ink particles not used for printing among the ink particles ejected by the nozzle; an ink recovery channel for recovering the ink particles recovered by the gutter into the ink container; and a second exhaust channel that discharges a gas recovered together with the ink particles through the ink recover channel from the solvent container to an exterior of the main body, in which the ink container and the solvent container are coupled with each other through a first exhaust channel, an exhaust gas and ink mist within the ink container are supplied to the solvent container through the first exhaust channel, and the solvent container is equipped with an ink mist removal unit that removes the ink mist supplied from the first exhaust channel.

According to the aspect of the present invention, the deposition of the ink mist that flows in the exhaust channels together with the gas within the exhaust routes can be reduced.

Also, according to the aspect of the present invention, ink contamination of the circumference of the inkjet recording apparatus caused by allowing the ink mist to be discharged to the exterior can be reduced.

DETAILED DESCRIPTION

Hereinafter, this embodiment will be described in detail with reference to the accompanying drawings. The present invention is not limited to the following embodiment.

Embodiment (Configuration of Apparatus Exterior)

Figure 1:
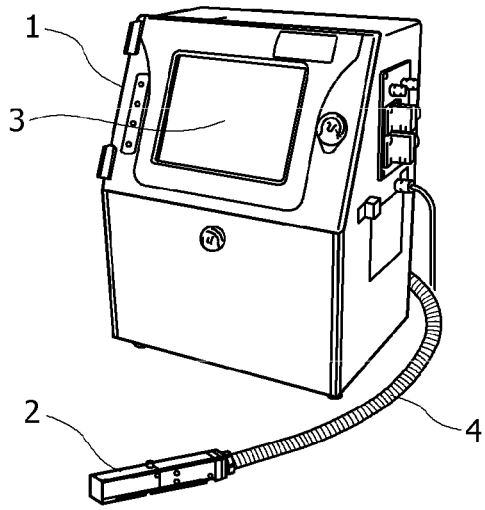
FIG. 1 is a perspective view of a main body and a print head in an inkjet recording apparatus.

FIG. 1 is a perspective view illustrating an inkjet recording apparatus 100. The inkjet recording apparatus 100 includes a main body 1 externally equipped with an operation display unit 3, and a print head 2. The main body 1 and the print head 2 are connected to each other by a conducting pipe.

(Operation Principle of Apparatus)

Figure 2:
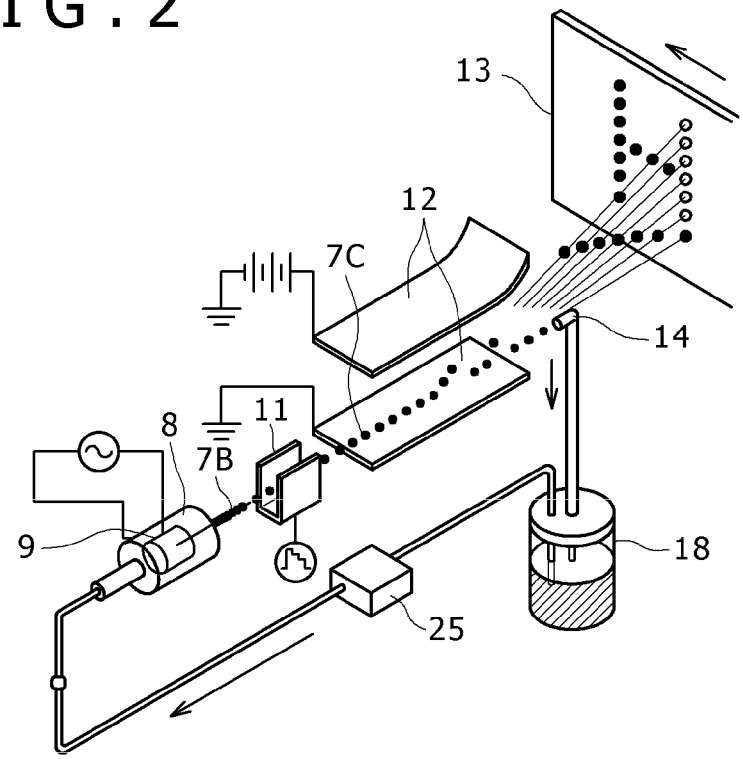
FIG. 2 is a perspective view illustrating a basic operation of the inkjet recording apparatus.

Now, an operation principle of the inkjet recording apparatus 100 will be described. As illustrated in FIG. 2, an ink 7A within an ink container 18 is sucked and pressurized into an ink column 7B by a pump 25, and then ejected from a nozzle 8. The nozzle 8 is equipped with an electrostrictive element 9, which subjects the ink to vibration at a given frequency so as to particulate the ink column 7B to be ejected from the nozzle 8. The number of ink particles 7C thus generated is determined according to a frequency of an excitation voltage to be applied to the electrostrictive element 9, and have the same number as the frequency. The ink particles 7C are given electric charge by applying a voltage having a magnitude corresponding to print information by charging electrodes 11. The ink particles 7C charged with the charging electrodes 11 are subject to a force proportional to the amount of electric charge and deflected while flying in an electric field between deflection electrodes 12. Then, the ink particles 7C fly toward an object to be printed 13, and lands thereon. In this situation, a landing position of the ink particles 7C in the deflection direction is changed according to the amount of electric charge, and a production line moves the object to be printed 13 in a direction orthogonal to the deflection direction with the result that the particles can be landed even in the direction orthogonal to the deflection direction, and a character is configured by a plurality of landing particles to conduct printing.

The ink particles 7C that have not been used for printing fly linearly between the deflection electrodes 12, pass through the route after having been trapped by a gutter 14, and are recovered into the main ink container 18.

(Use Form of Apparatus)

Figure 3:
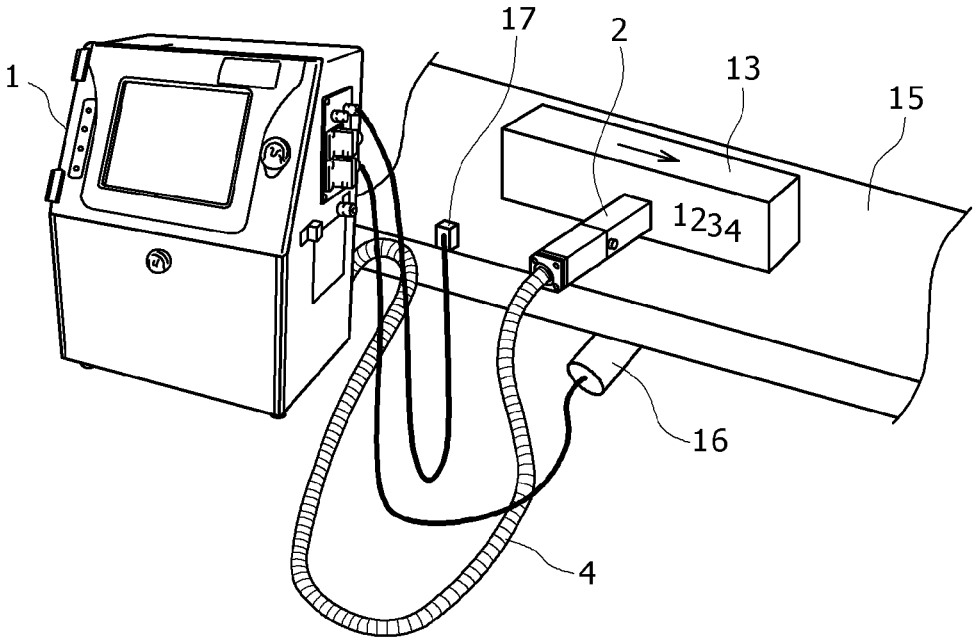
FIG. 3 is a perspective view illustrating a use state of the inkjet recording apparatus.

An example of actual use forms of the inkjet recording apparatus 100 is illustrated in FIG. 3. The inkjet recording apparatus 100 is installed in the production line within a factory where, for example, foods or beverages are produced. The main body 1 is located at a position where a user can operate the main body 1, and the print head 2 is located at a position where the print head 2 can come close to the object to be printed 13 which is fed on the production line such as a belt conveyer 15.

In order to print with the same width regardless of a feed speed, on the production line such as the belt conveyer 15 are located an encoder 16 that outputs a signal responsive to the feed speed to the inkjet recording apparatus 100, and a print sensor 17 that detects the object to be printed 13, and outputs a signal for ordering printing to the inkjet recording apparatus 100. The encoder 16 and the print sensor 17 are connected to a controller not shown within the main body 1. The controller controls the amount of electric charge and a charging timing to the ink particles 7C ejected from the nozzle 8 according to signals from the encoder 16 and the print sensor 17, and attaches the charged and deflected ink particles 7C to the object to be printed 13 while the object to be printed 13 is passing through a neighborhood of the print head 2, for conducting printing.

(Route Configuration of Embodiment)

Figure 4:
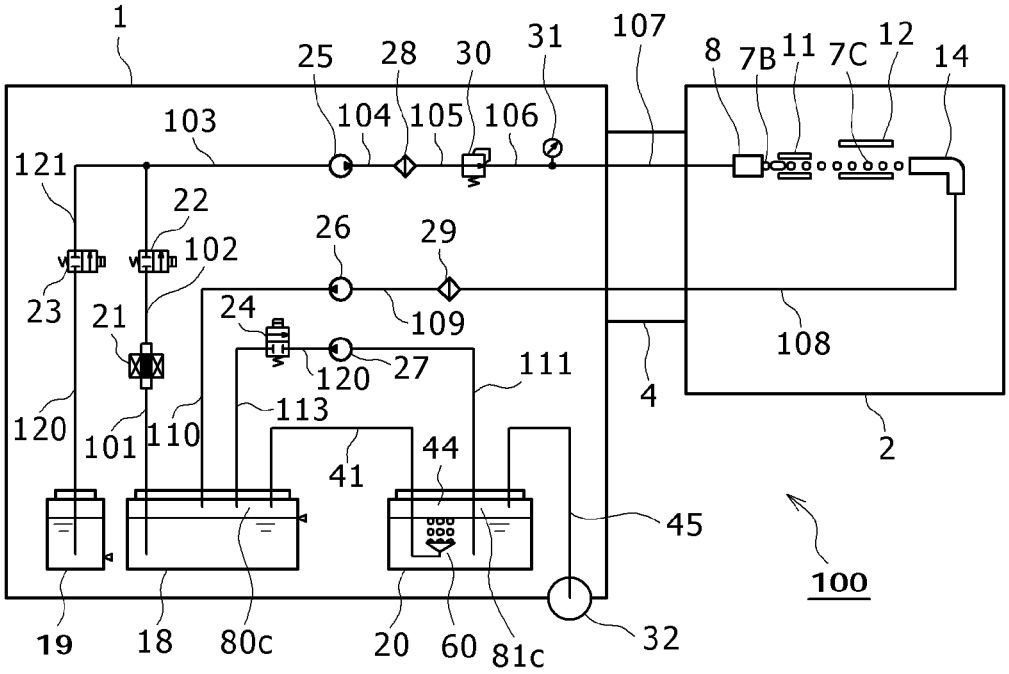
FIG. 4 is a configuration diagram illustrating a route of an inkjet recording apparatus according to a first embodiment of the present invention.

FIG. 4 is an illustrative view illustrating an overall route configuration of the inkjet recording apparatus 100. The main body 1 is equipped with the main ink container 18 that retains a circulating ink therein. The main ink container 18 is equipped with a viscosity measurement unit 21 which is a falling ball viscometer for measuring a viscosity of the ink through a route 101 for circulating the ink.

The viscosity measurement unit 21 is connected to an electromagnetic valve 22 that opens and closes the route through a route 102, and the electromagnetic valve 22 is connected to the pump 25, which contributes to the suction and pumping of the ink and the solvent, through a route 103. The pump 25 is connected to a filter 28, which removes foreign material mixed in the ink, through a route 104.

The filter 28 is connected to a pressure reducing valve 30, which adjusts a pressure of the ink pumped from the pump 25 to a pressure suitable for printing, through a route 105. The pressure reducing valve 30 is connected to a pressure sensor 31 for detecting the ink pressure through a route 106.

The pressure sensor 31 is connected to the nozzle 8 having an ejection port for ejecting the ink, which is disposed within the print head 2, through a route 107 that passes into a conducting pipe 4.

The charging electrodes 11 that charge ink particles 10 ejected from the nozzle 8 with the amount of electric charge corresponding to character information to be printed are disposed in an ink ejection direction of the nozzle 8. Deflection electrodes 12, which develop an electric field for deflecting the charged ink particles 10, are disposed in the flying direction of the ink particles 7C charged by the charging electrodes 11.

The gutter 14, which traps the ink particles 7C that linearly fly without being charged and deflected because the ink particles 7C are not used for printing, is disposed on an ink flying direction side of the deflection electrodes 12. The gutter 14 is connected to a filter 29 for removing the foreign material mixed in the ink, which is arranged within the main body 1, through a route 108 that passes through the conducting pipe 4. The filter 29 is connected to a pump 26, which sucks the ink particles 7C trapped by the gutter 14, through a route 109. The pump 26 recovers the sucked ink particles 7C into the main ink container 18 through a route 110.

Also, the main body 1 is equipped with a solvent container that accommodates a solvent 53 for eliminating the ink contamination of the nozzle 8 and adjusting the concentration of the ink. The solvent container 20 is connected to a pump 27, which sucks and pumps the solvent, through a route 111. Also, the pump 27 is connected to an electromagnetic valve 24, which opens and closes the route, through a route 112, and the electromagnetic valve 24 is connected to the main ink container 18 through a route 113.

Further, the main body 1 is equipped with an auxiliary ink container 19 that retains a replenishment ink therein, and the auxiliary ink container 19 is connected to an electromagnetic valve 23, which opens and closes the route, through a route 120. The electromagnetic valve 23 is connected to the route 103 through a route 121.

(Exhaust Route)

As illustrated in FIG. 4, the gutter 14 also sucks a circumambient air while the ink particles 7C are sucked and recovered. The sucked air is discharged is fed into the main ink container 18, and discharged from the interior of the main ink container 18 to the exterior of the main body 1 through a route 40.

The main body 1 is equipped with an outlet 32, and the outlet 32 is connected to a gas portion 44 of the solvent container 20 through a route 45. A volatilized solvent component in the ink is exhausted to the exterior of the main body 1 through the route 45. A gas portion 80*c* of the main ink container 18 is connected to a gas exhaust port 60 of the solvent container 20 through a route 41, and the gas exhaust port 60 is arranged in the solvent 53.

(Description of Solvent Container According to the Invention)

Figure 8:
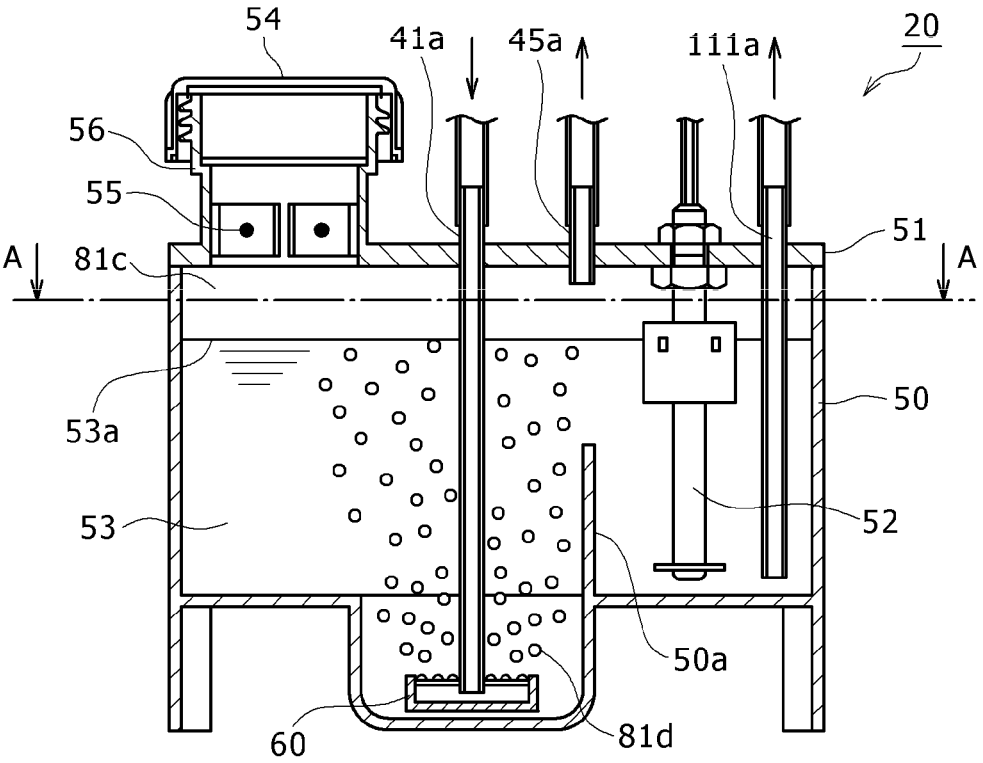
FIG. 8 is a vertically cross-sectional view illustrating a solvent container having a mist removal function according to an embodiment of the present invention.

FIG. 8 illustrates a vertically cross-sectional view of the solvent container 20 according to an embodiment of the present invention, which is a cross-sectional view (FIG. 9) taken along a line A-A in FIG. 8.

The solvent container 20 according to this embodiment includes a solution storage unit 50 that retains the solvent 53 therein, and an upper cover 51 that is disposed on an upper side of the solution storage unit 50. In this example, the solution storage unit 50 and the upper cover 51 are fixed to each other, for example, with hot plate welding, or screws.

The upper cover 51 includes a fluid level sensor 52 that detects a fact that a fluid level 53*a* of the solvent 53 falls below a given value, a pipe (for solvent supply) 111*a* that is connected to the route 111, a pipe (for exhaust IN) 41*a* that is connected to the route 41, and a pipe (for exhaust OUT) 45*a* that is connected to a route 46. The pipe (for solvent supply) 111*a* is configured to have a leading end immersed in the solvent 53. The leading end of the pipe (for exhaust OUT) 45*a* is disposed above the fluid level 53*a*, and contacts with an exhaust gas 81*c*.

The pipe (for exhaust IN) 41*a* has a leading end connected to the gas exhaust port 60. The gas exhaust port 60 is arranged to be immersed in the solvent 53, and designed to discharge an exhaust gas (air bubble) 81*d* into the solvent 53.

Figure 9:
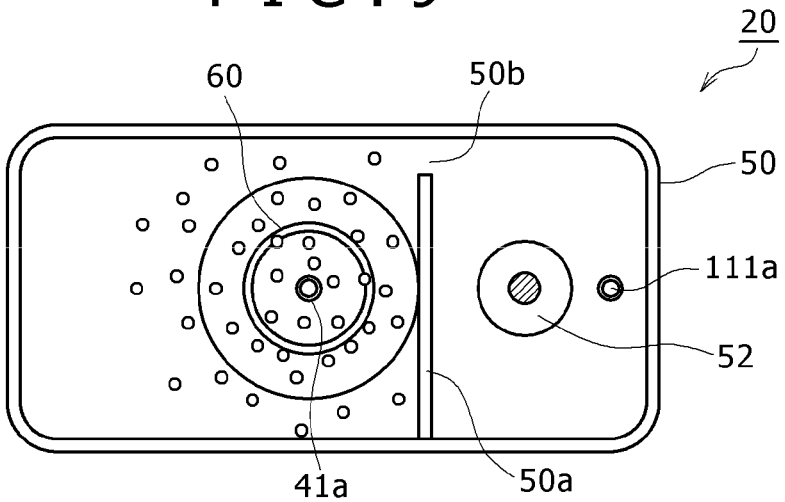
FIG. 9 is a horizontally cross-sectional view illustrating the solvent container having the mist removal function according to the embodiment of the present invention.

The solution storage unit 50 is equipped with a partition 50*a*. The provision of the partition 50*a* makes it possible to prevent the exhaust gas (air bubble) 81*d* from affecting the detection of the fluid level 53*a* by the fluid level sensor 52. In this example, as illustrated in FIG. 9, a gap 50*b* is formed between the partition 50*a* and one surface of wall surfaces configuring the solution storage unit 50, and the solvent 53 flows into the gap 50*b*.

Figure 10:
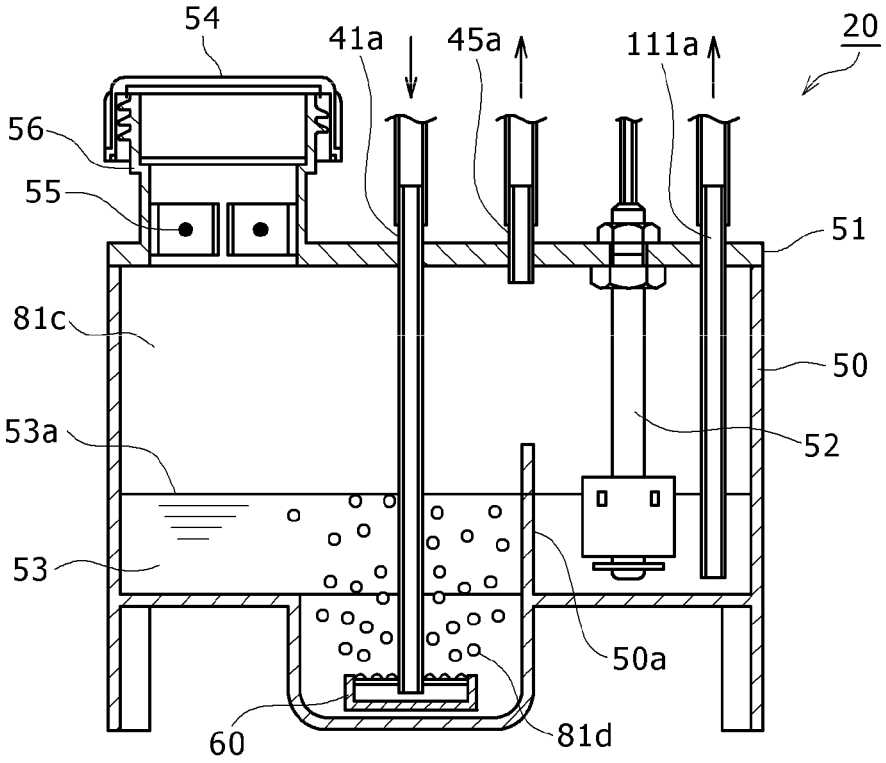
FIG. 10 is a vertically cross-sectional view illustrating a state in which a fluid level in the solvent container having the mist removal function is low according to an embodiment of the present invention.

FIG. 10 illustrates a state in which the fluid level 53*a* within the solvent container 20 is lowered. The fluid level sensor 52 detects a fact that the fluid level 53*a* is lowered, and issues an alarm for ordering the replenishment ink of the solvent 53. Even in this state, the gas exhaust port 60 is lower than the fluid level 53*a*, and immersed in the solvent 53. The upper cover 51 includes a spout 56 for replenishing the solvent 53, a filter 55 that is arranged in the spout 56 for the purpose of preventing dust from being mixed into the solvent container 20, and a cap 54 that can be opened and closed when replenishing the solvent 53.

(Description of Gas Exhaust Port 60)

A configuration of the gas exhaust port 60 will be described with reference to FIG. 11. The gas exhaust port 60 includes a body 62 that is connected to the pipe (for exhaust IN) 41*a*, a base 61 that is disposed below the body 62, a porous component 63 that is installed on an upper portion of the body 62, and a ring 64 and a nut 65 which are disposed to fix the porous component 63.

Figure 11:
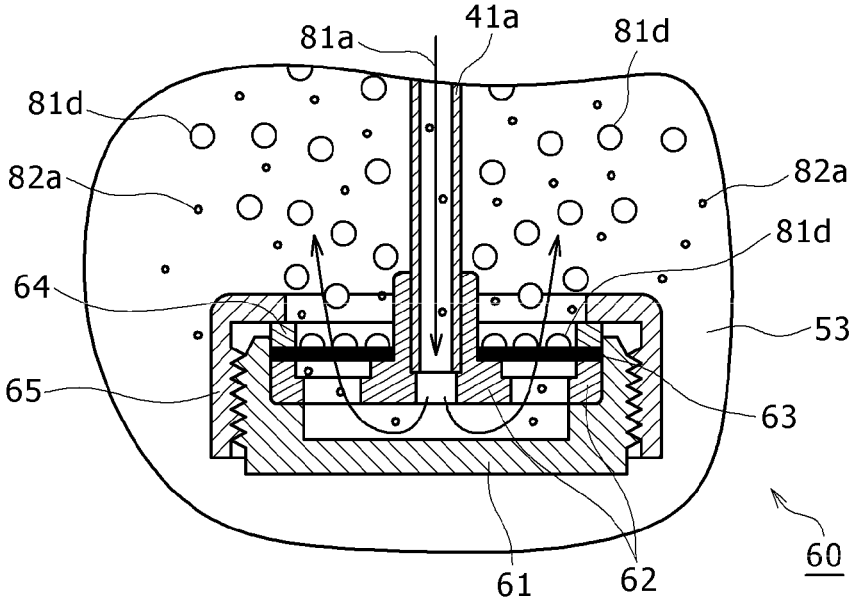
FIG. 11 is a cross-sectional view illustrating an exhaust gas discharge opening within the solvent container in the inkjet recording apparatus according to the embodiment of the present invention.

Arrows in FIG. 11 represent a flow of an exhaust gas 81*a*. The exhaust gas 81*a* flows together with an ink mist 82*a*, and at least a part of the ink mist 82*a* is dissolved in the solvent 53 when the exhaust gas 81*a* passes through the porous component 63. Also, the exhaust gas 81*a* becomes the exhaust gas (air bubble) 81*d* when the exhaust gas 81*a* passes through the porous component 63. The exhaust gas (air bubble) 81*d* goes up within the solvent 53, and joins the exhaust gas (upper portion of solvent container) 81*c*.

(Ink Concentration of Solvent)

Figure 12:
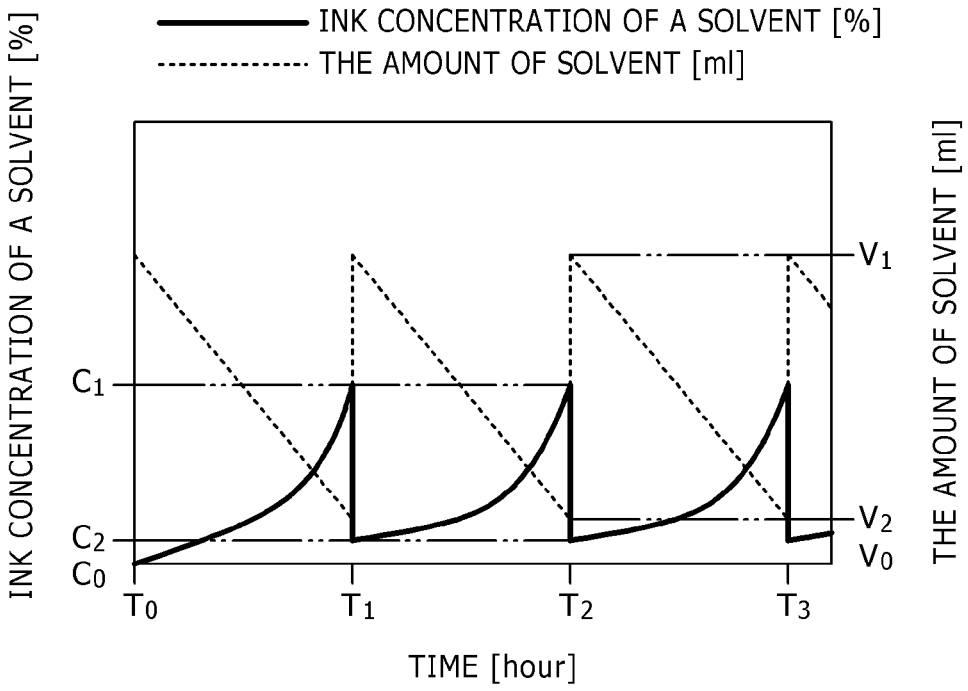
FIG. 12 is a diagram illustrating the amount of solvent within the solvent container and a change in ink concentration according to the embodiment of the present invention.

The solvent 53 in the solvent container 20 dissolves the ink mist 82*a* to raise the ink concentration. FIG. 12 is a diagram illustrating the amount of solvent within the solvent container and a change in ink concentration according to the embodiment of the present invention.

In the figure, symbol T0 is 0 time of operation, T1 to T3 are solvent replenishment times, C0 is ink concentration 0%, C1 is the ink concentration of the solvent 53 immediately before replenishment, C2 is the ink concentration of the solvent 53 immediately after replenishment, V0 is the amount 0 ml of the solvent 53, V1 is the amount of the solvent 53 immediately before replenishment, and C2 is the amount of the solvent 53 immediately after replenishment. In this example, it can be confirmed that the ink concentration of the solvent 53 is not equal to or more than a given value. For example, when it is assumed that a decrement (the amount of volatilization) of the solvent 53 is 5 ml and V1 is 1000 ml at the time of ejecting the ink, the maximum ink concentration C1 is about 0.01%. The ink concentration of the solvent 53 is of the level affecting the apparatus.

(Ink Mist in Exhaust Route, and Advantages of the Invention)

Figure 5:
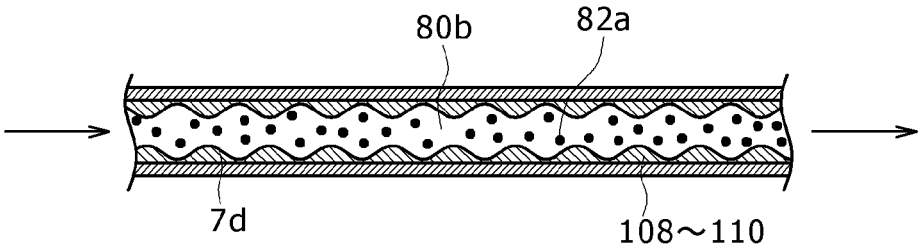
FIG. 5 is an enlarged view of an ink recovery route.
Figure 6:
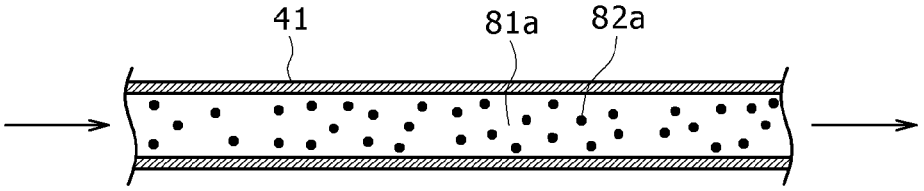
FIG. 6 is an enlarged view of an exhaust route (before mist removal)
Figure 7:
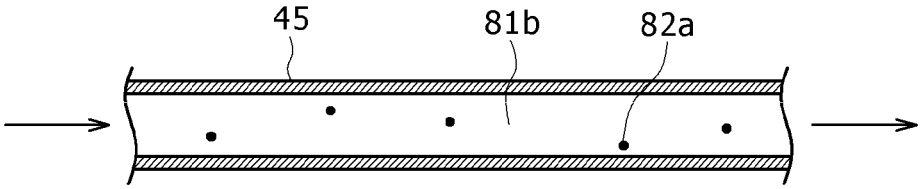
FIG. 7 is an enlarged view of the exhaust route (after mist removal)

FIG. 5 illustrates a cross-sectional view of the ink recovery route. In the routes 108 to 110, an ink 7*d* and an air 80*b* flow together to generate an ink mist 82*a*. FIG. 6 illustrates a cross-sectional view of the route (for exhaust) 41. In the route 41, an exhaust gas 81 as well as an ink mist 82*a* flow. FIG. 7 illustrates a cross-sectional view of the route (for exhaust) 45. The route 45 is smaller in the amount of ink mist 81*c* than the route 41.

According to the present invention, because the discharge of the ink mist 81*c* to the exterior of the apparatus can be reduced, there can be used the inkjet recording apparatus that can keep the clean circumference of the apparatus.

What is claimed is:

1. An inkjet recording apparatus comprising:

an ink container configured to store ink, the ink container housed in a main body;

a solvent container configured to accommodate solvent, and configured to supply the solvent to the ink container in order to adjust a concentration of the ink within the ink container, the solvent container including:

a solution storage unit configured to retain the solvent therein, an ink mist removal unit configured to remove ink mist, a fluid level sensor configured to detect when a fluid level of the solvent falls below a given value in the solvent container, a partition configured to prevent exhaust gas from affecting the detection of the fluid level by the fluid level sensor in the solvent container, wherein the partition is provided between the ink mist removal unit and the fluid level sensor, and a gap formed between the partition and one of a plurality of wall surfaces configuring the solution storage unit, such that the solvent flows into the gap;

a first exhaust channel configured to couple the ink container to the solvent container, wherein the first exhaust channel is configured to supply exhaust gas and ink mist from the ink container to the solvent container;

a nozzle configured to elect, as ink particles, the ink supplied from the ink container through an ink supply channel, in order to conduct printing on an object to be printed;

a gutter configured to recover the ink particles not used for printing among the ink particles ejected by the nozzle;

an ink recovery channel configured to recover, into the ink container, the ink particles recovered by the gutter; and a second exhaust channel configured to discharge a gas to an exterior of the main body, the gas recovered together with the ink particles, through the ink recovery channel from the solvent container.

2. The inkjet recording apparatus according to claim 1, wherein the ink mist removal unit is disposed on one end of the first exhaust channel, and the solvent is allowed to pass through the ink mist removal unit to remove the ink mist.

3. The inkjet recording apparatus according to claim 1 or 2, wherein the one end of the first exhaust channel is connected to the solvent container.

4. The inkjet recording apparatus according to claim 1 or 2, wherein the solvent used in the ink mist removal unit is a methyl ethyl ketone solvent.

* * * * *